US008176862B2

(12) United States Patent
Birdwell

(10) Patent No.: US 8,176,862 B2
(45) Date of Patent: May 15, 2012

(54) FITTED TABLECLOTH

(76) Inventor: Jane Birdwell, Pensacola, FL (US)

( * ) Notice: Subject to any disclaimer, the term of this patent is extended or adjusted under 35 U.S.C. 154(b) by 400 days.

(21) Appl. No.: 12/592,512

(22) Filed: Nov. 25, 2009

(65) Prior Publication Data

US 2011/0120360 A1 May 26, 2011

(51) Int. Cl.
*D05B 13/00* (2006.01)
*A47B 13/08* (2006.01)
*B65D 65/00* (2006.01)

(52) U.S. Cl. ..... 112/475.08; 108/90; D6/617; 150/158

(58) Field of Classification Search ..... 112/475.08, 112/475.06, 475.01, 153, 147, 441; 5/493, 5/486, 497; 297/228.1, 228.11–228.13; 108/90; D6/596, 602, 606, 617; 150/158
See application file for complete search history.

(56) References Cited

U.S. PATENT DOCUMENTS

| | | | | |
|---|---|---|---|---|
| 1,926,429 | A | 9/1933 | Bendelari | |
| 2,245,779 | A * | 6/1941 | Heil | 5/499 |
| 2,637,136 | A | 5/1953 | Mark | |
| 2,809,466 | A | 10/1957 | Glover | |
| 3,368,601 | A * | 2/1968 | Gantert-Merz | 108/90 |
| 3,557,856 | A | 1/1971 | Berman | |
| 4,153,097 | A * | 5/1979 | Pettibone | 160/330 |
| 4,705,084 | A | 11/1987 | Rodebaugh et al. | |
| 5,506,019 | A | 4/1996 | Abeyta et al. | |
| 5,733,397 | A * | 3/1998 | McDaniel | 156/66 |
| 6,557,193 | B1 * | 5/2003 | Griffith | 5/493 |
| 6,986,928 | B2 * | 1/2006 | Almansa Perea | 428/99 |
| 7,320,287 | B2 | 1/2008 | Edinger et al. | |
| 2005/0274298 | A1 * | 12/2005 | Paulin | 108/90 |

* cited by examiner

*Primary Examiner* — Ismael Izaguirre
(74) *Attorney, Agent, or Firm* — J. Wiley Horton

(57) ABSTRACT

A method for making a fitted tablecloth for covering a utility or card table is disclosed. The steps include providing a primary panel having a plurality of sides, providing a rail panel having a plurality of side panels and a plurality of pleats, such that the plurality of side panels are separated by the plurality of pleats, folding the plurality of pleats against the plurality of side panels such that the plurality of side panels meet at a plurality of joints, connecting the primary panel to the rail panel such that the plurality of side panels are connected to one another at a plurality of top joints, and stitching the side panels from the plurality of top joints to a portion of the side panel forming an inner seam.

18 Claims, 11 Drawing Sheets

FITTED TABLECLOTH

BACKGROUND OF THE INVENTION

1. Field of the Invention

This invention relates to the field of methods for covering furniture. More specifically, this invention comprises a method for making a fitted tablecloth to cover a table.

2. Description of the Related Art

Standard sized utility tables and card tables are often used for events, such as large or small dinner gatherings, trade shows or job fairs. The tables are usually rectangular and fold for easy storage. While the tables are generally unattractive, it is often desirable to use the utility tables for more formal or professional events. Tablecloths, used to cover a rectangular table, such as a utility table, are commonly used to protect or dress up a table.

Generally, tablecloths consist of an untailored cloth or plastic piece which lies loosely over the table, is difficult to put on the table and does not fully cover the legs of the table. Current tailored tablecloths often do not fit snuggly over the corners of the table and also do not fully cover the legs of the table. Thus, both untailored and tailored tablecloths often slide around on a table and can be unattractive at the corners of a table.

Therefore, what is needed is a method of making a tablecloth which covers the length of the table and the legs of the table, provides a snug fit at the corners of a present utility table, allows for easily putting on and taking off the tablecloth and prevents the tablecloth from sliding or blowing off of the table.

BRIEF SUMMARY OF THE INVENTION

The present invention comprises a method for making a fitted tablecloth for covering a utility or card table. The steps include providing a primary panel having a plurality of sides, providing a rail panel having a plurality of side panels and a plurality of pleats, such that the plurality of side panels are separated by the plurality of pleats, folding the plurality of pleats against the plurality of side panels such that the plurality of side panels meet at a plurality of joints, connecting the primary panel to the rail panel such that the plurality of side panels are connected to one another at a plurality of top joints, and stitching the side panels from the plurality of top joints to a portion of the side panel forming an inner seam.

BRIEF DESCRIPTION OF THE SEVERAL VIEWS OF THE DRAWINGS

FIG. 6 is a perspective view, showing the manner in which the pleats of the rail panel are folded in.

REFERENCE NUMERALS IN THE DRAWINGS

| | |
|---|---|
| 10 | tablecloth |
| 12 | primary panel |
| 14 | rail panel |
| 16 | table |
| 18 | first side panel |
| 20 | second side panel |
| 22 | third side panel |
| 24 | fourth side panel |
| 26 | end pleat |
| 28 | first pleat |
| 30 | second pleat |
| 32 | third pleat |
| 34 | end pleat |
| 36 | notches |
| 38 | stitches |
| 40 | hem |
| 42 | inner seams |
| 44 | first joint |
| 46 | second joint |
| 48 | third joint |
| 50 | fourth joint |
| 52 | pleat seams |

DETAILED DESCRIPTION OF THE INVENTION

Figure 1:
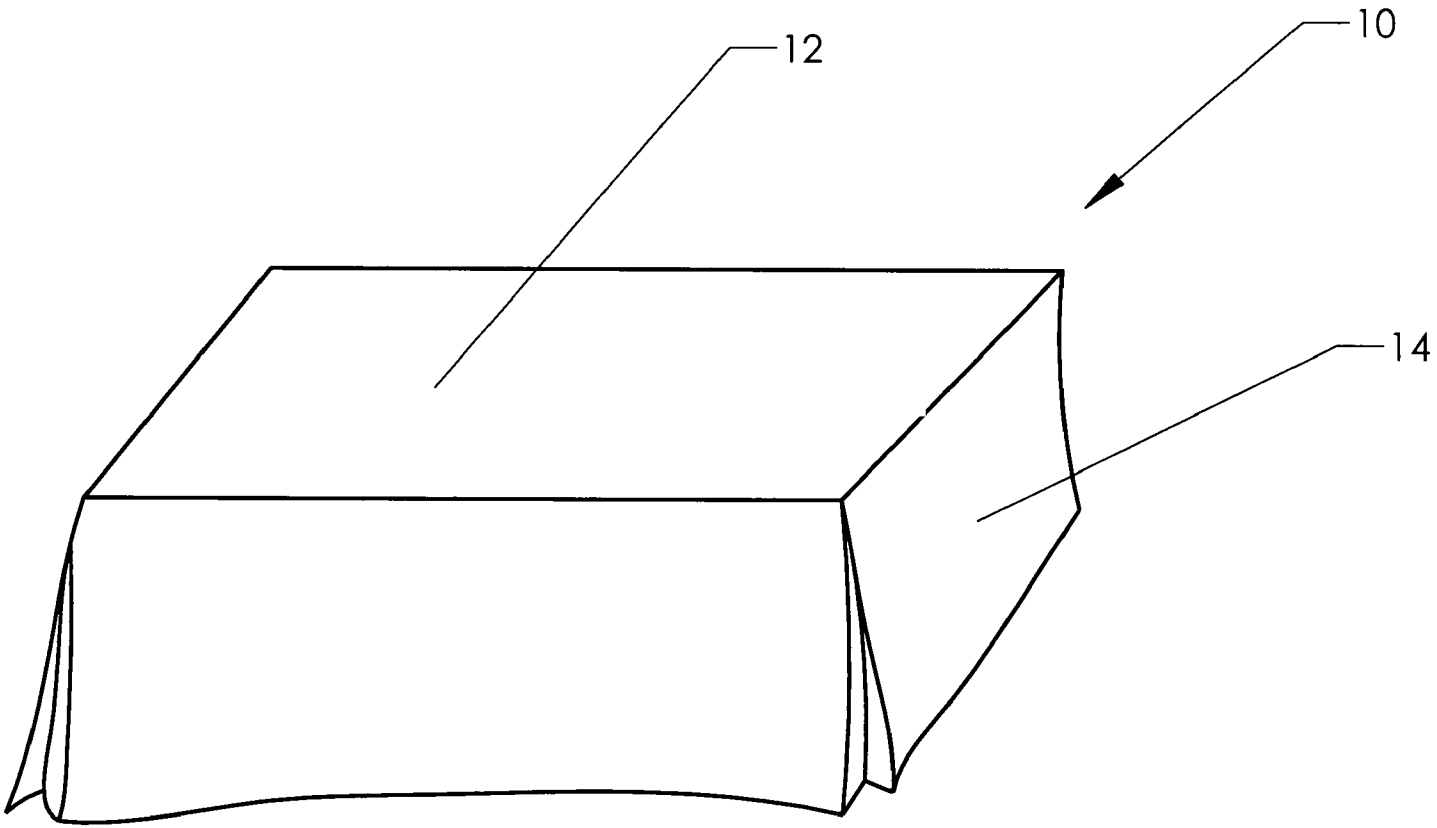
FIG. 1 is a perspective view, showing the present tablecloth.
Figure 2:
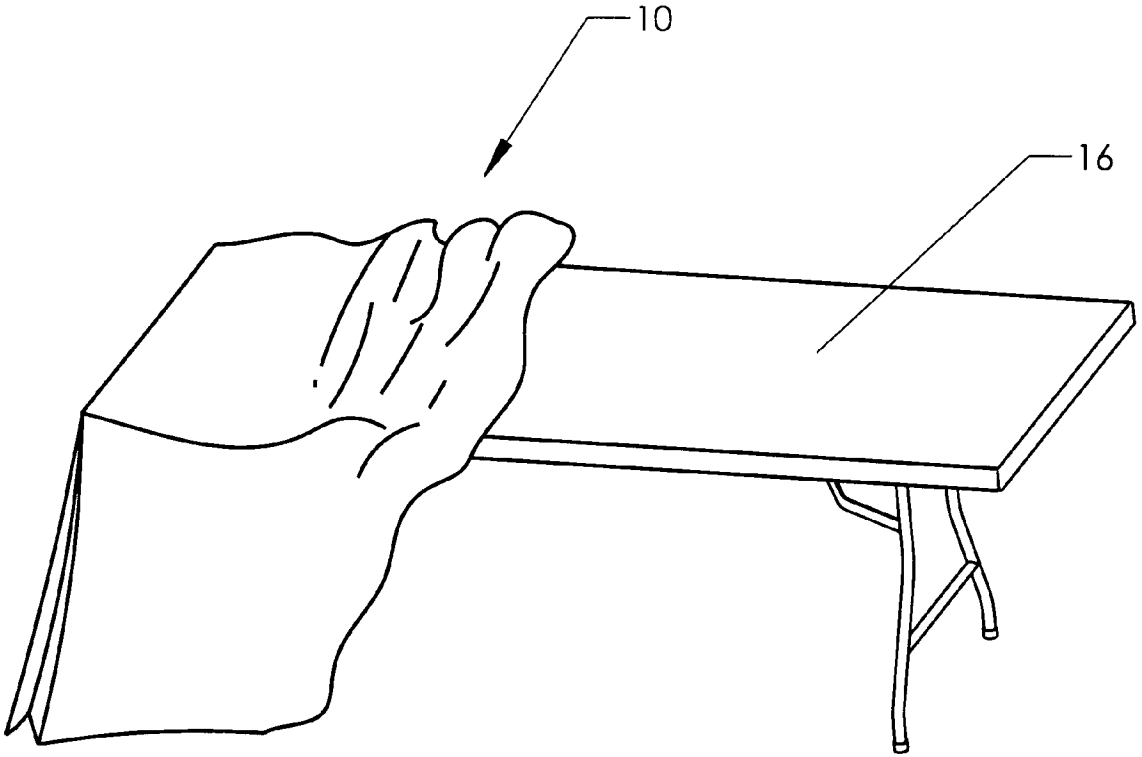
FIG. 2 is a perspective view, showing the present tablecloth being placed onto a standard utility table.

FIG. 1 shows tablecloth 10 primarily comprised of rail panel 14 and primary panel 12. Tablecloth 10 is shown being placed over prior art table 16 in FIG. 2. Table 16 is shown as a standard utility table with four legs however tablecloth 10 can cover any rectangular or square table with any number of legs. Tablecloth 10 covers the length of table 16, fully covers the legs of table 16, provides a snug fit at the corners of table 16, and does not slide or blow off of table 16. Tablecloth 10 is easy to take on and off of table 16.

Figure 3:
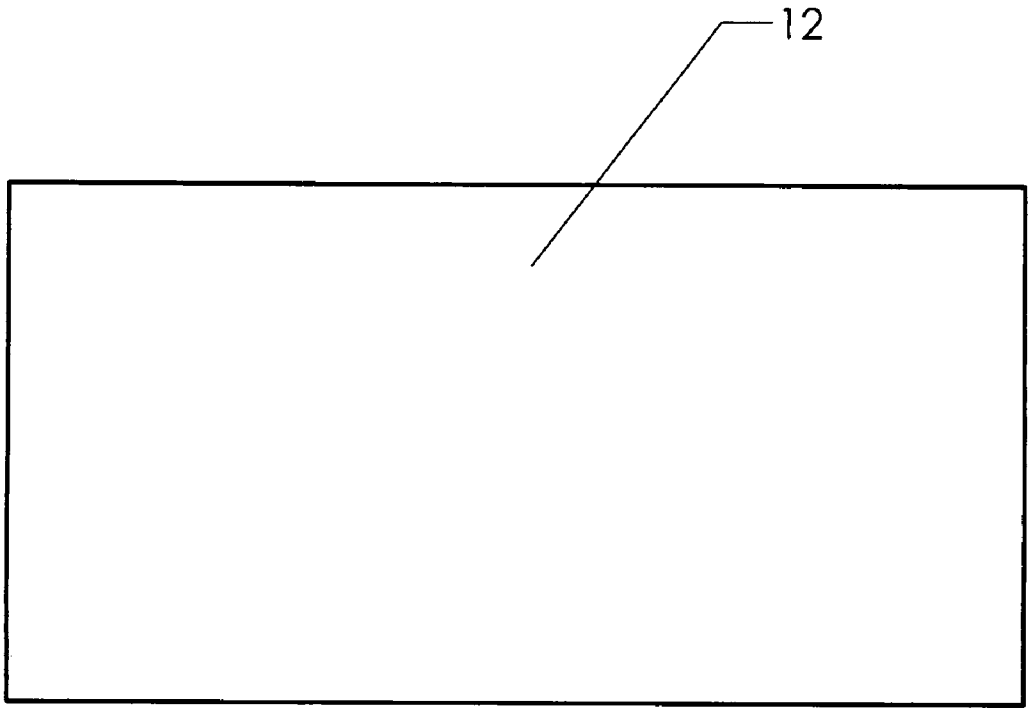
FIG. 3 is a perspective view of the primary panel of the present tablecloth.
Figure 4:
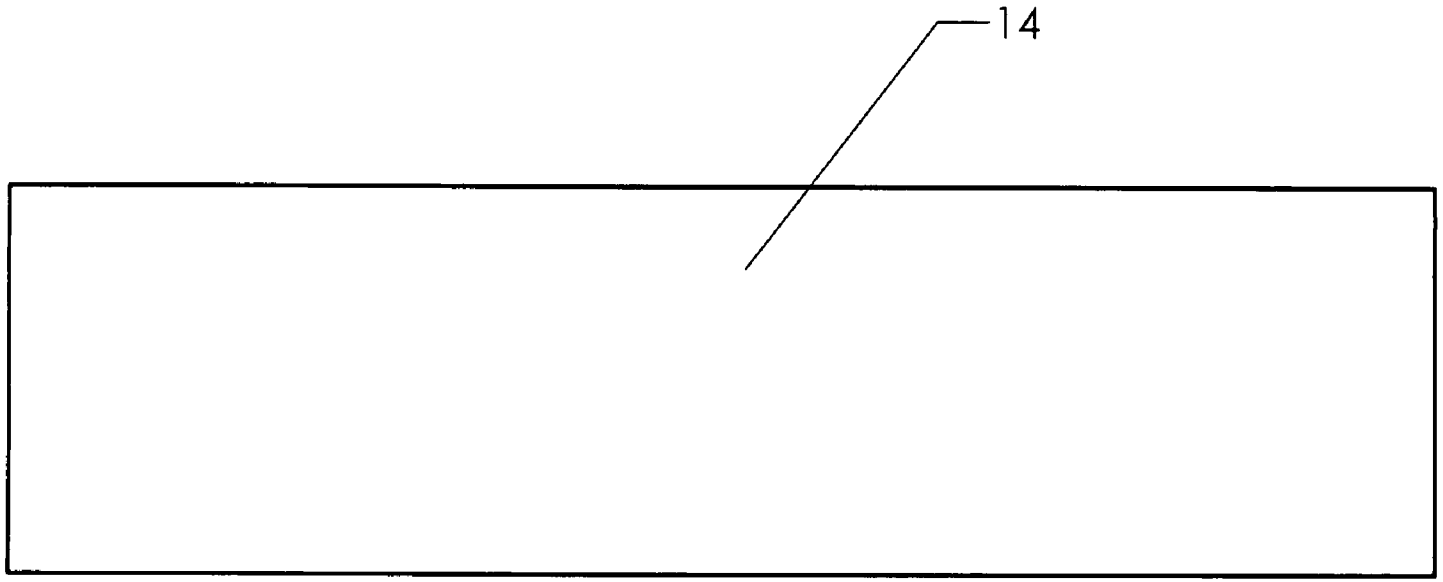
FIG. 4 is a perspective view of the rail panel of the present tablecloth.

FIG. 3 shows primary panel 12 which comprises the top of tablecloth 10 and preferably has four sides. Primary panel 12 is approximately the same size as the top of the table which the user will be covering. Rail panel 14 is shown in FIG. 4. Rail panel 14 has four sides and has a length that is greater than the length of primary panel 12. Rail panel 14 has a width that is approximately the height of table 16.

Figure 5:
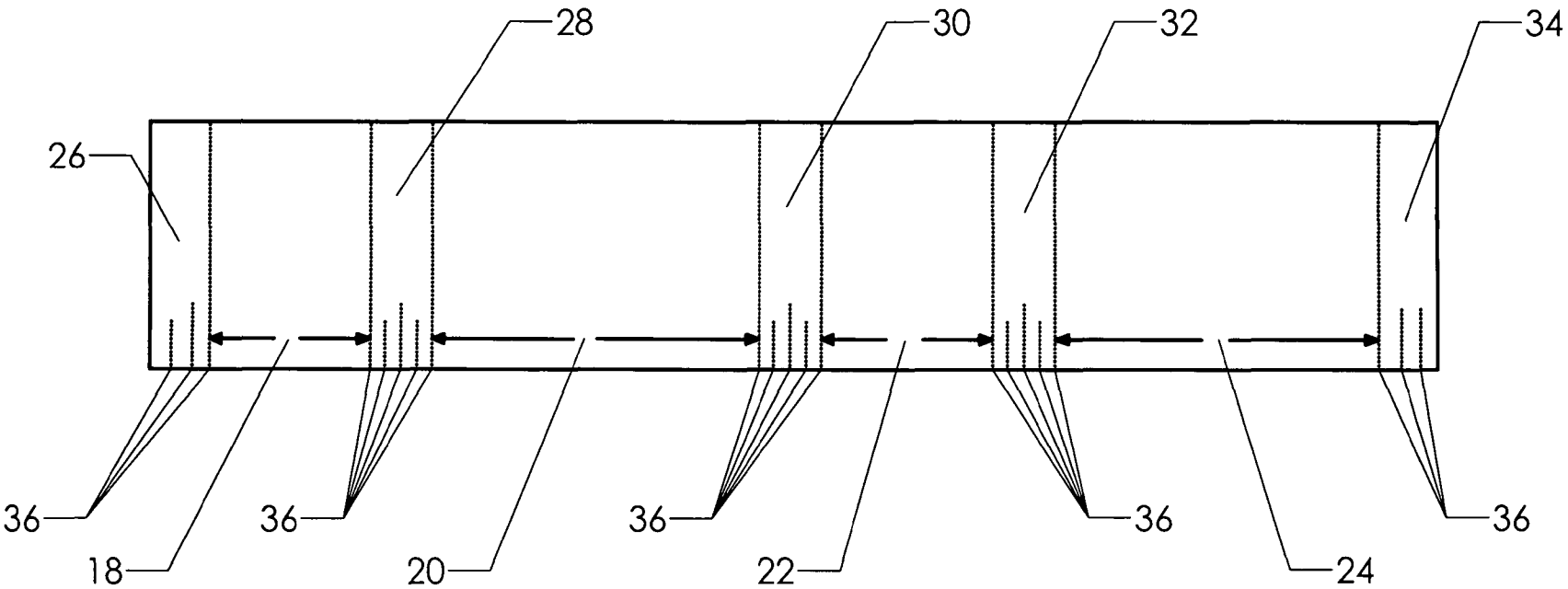
FIG. 5 is a perspective view, showing the relevant notches on the rail panel of the present tablecloth.

FIG. 5 shows the notching of rail panel 14 at notches 36 for use as pleat marks. The rail panel 14 is divided into nine sections consisting of five pleat sections and four side panels. The five pleat sections consist of end pleat 26, first pleat 28, second pleat 30, third pleat 32, and end pleat 34. The four side panels consist of first side panel 18, second side panel 20, third side panel 22 and fourth side panel 24.

Figure 6:
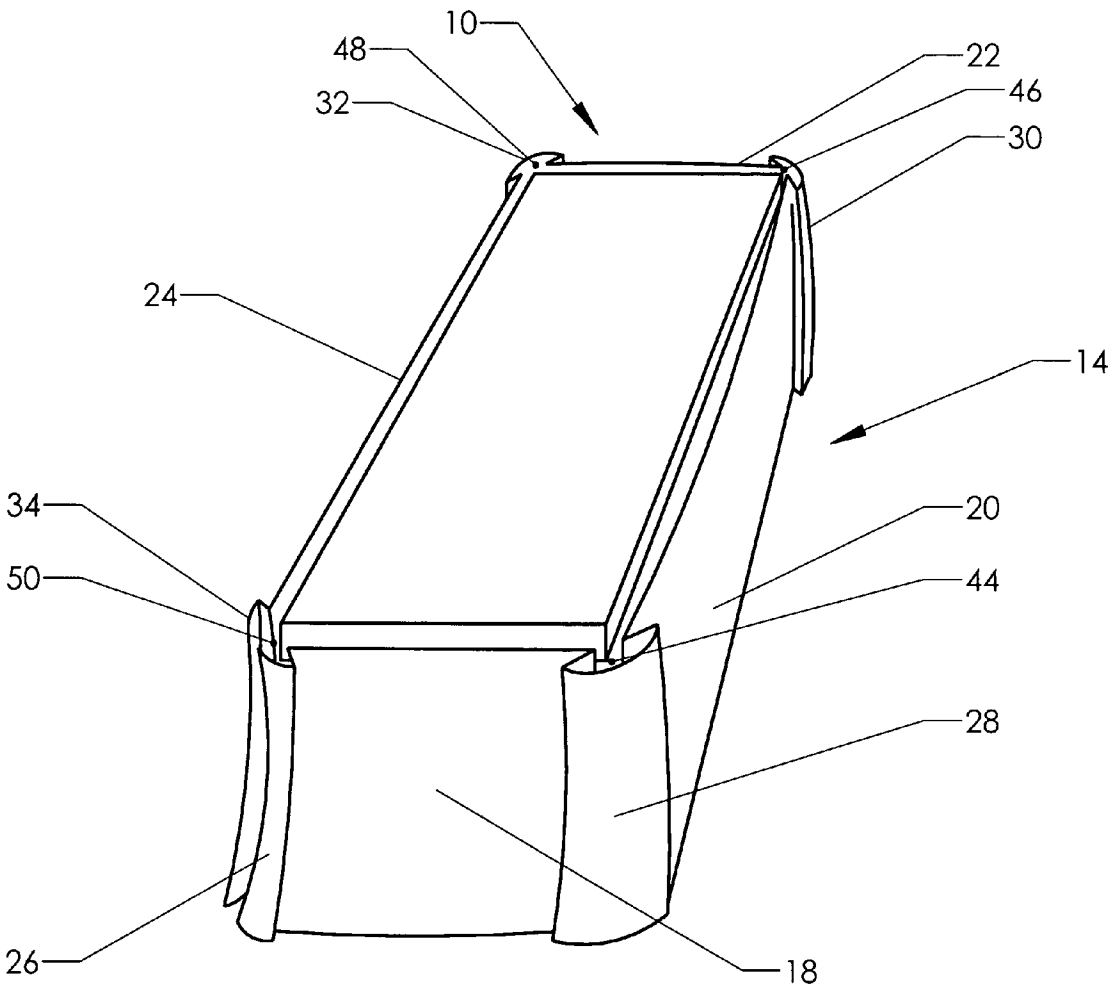

FIG. 6 illustrates the manner in which the pleats of rail panel 14, end pleats 26, 34, first pleat 28, second pleat 30, and third pleat 32, are folded in. As shown, side panels (18, 20, 22, 24) meet respectively at each corner after pleats (26, 28, 30, 32, 34) are folded in. First side panel 18 and second side panel 20 meet at first joint 44. Second side panel 20 and third side panel 22 meet at second joint 46. Third side panel 22 and fourth side panel 24 meet at third joint 48. Fourth side panel 24 and first side panel 18 meet at fourth joint 50.

Figure 7:
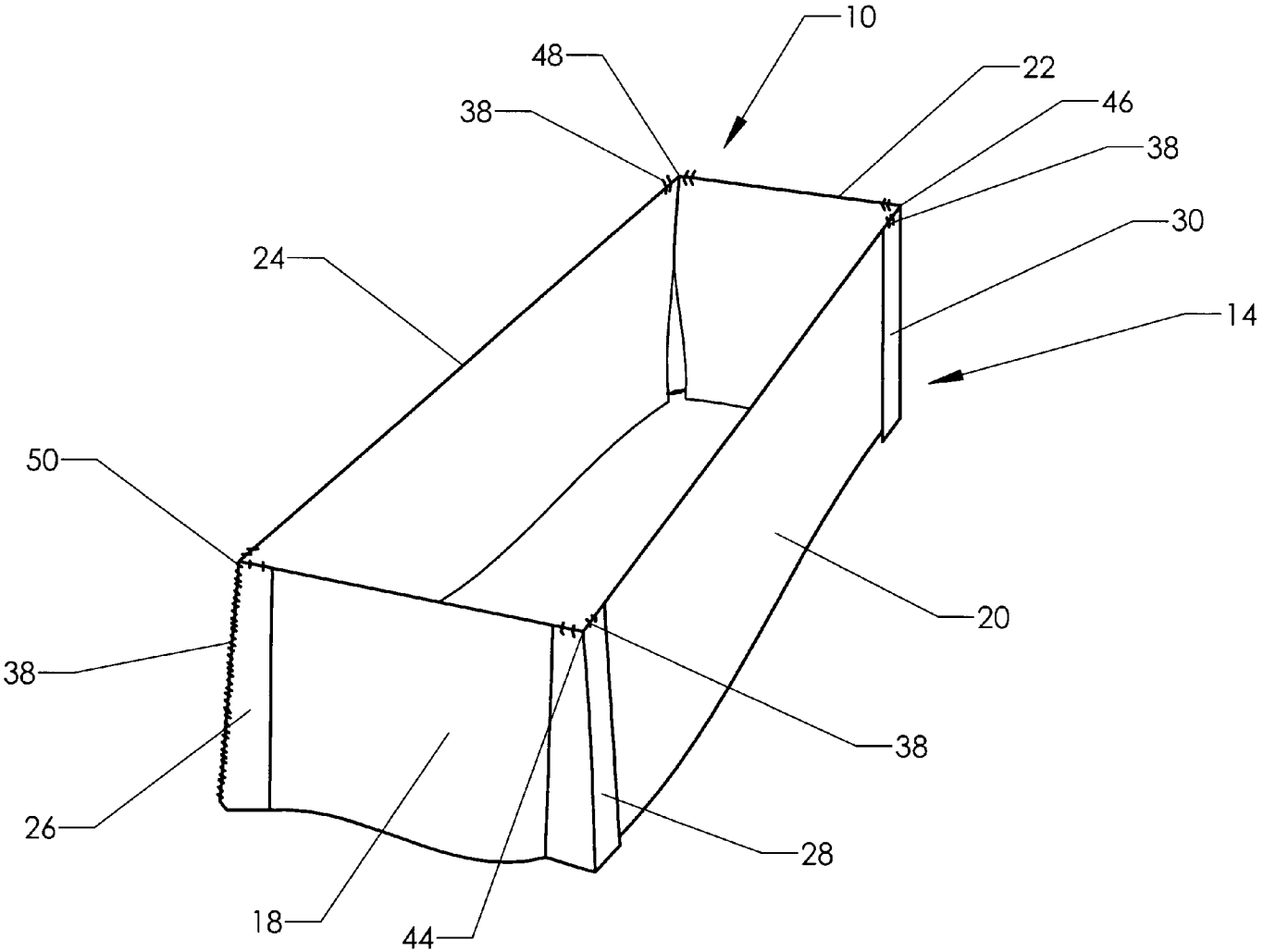
FIG. 7 is a perspective view, showing the manner in which top of rail panel is stitched, folding in pleats.

The top of rail panel 14 is then stitched, folding in first pleat 28, second pleat 30, third pleat 32 and end pleats 26, 34 as shown in FIG. 7. It is important that when the top of rail panel 14 is stitched, the pleats are positioned along the peripheral side of the rail panel 14, as illustrated. The stitches made along the top of rail panel 14 are preferably overlock stitches; however, one skilled in the art would understand that many different types of stitching could be used. The pleats can be folded in prior to or concurrent with the step in which the top of rail panel 14 is stitched together with pleats folded in. First joint 44, second joint 46, third joint 48, and fourth joint 50 are shown in FIG. 7 where side panels (18, 20, 22, 24) meet. End pleats 26 and 34 are stitched together, such that rail panel 14 is connected at both ends. However, end pleats, 26 and 34, can be stitched together prior to or after the top of rail panel 14 is stitched together with pleats folded in.

Figure 8:
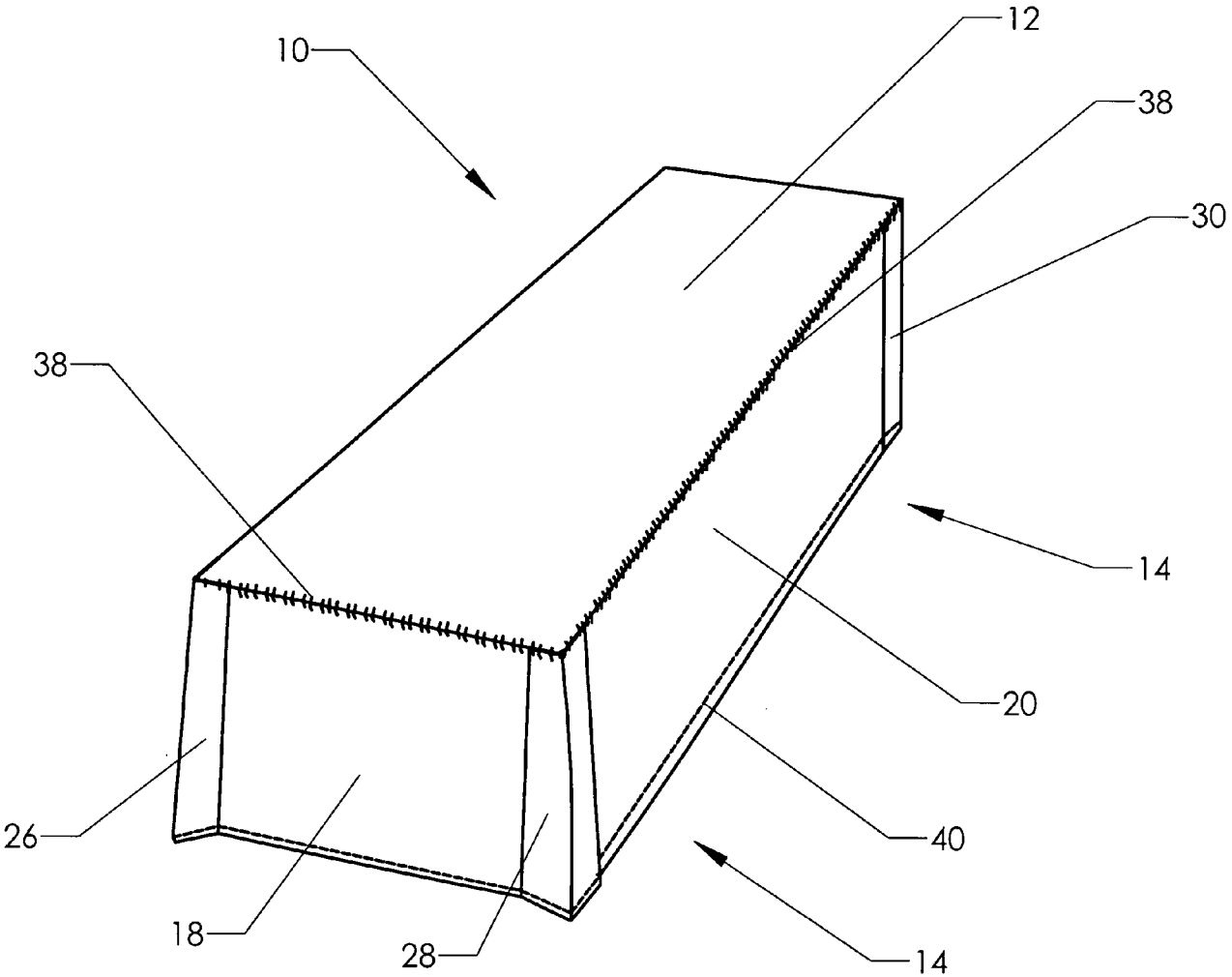
FIG. 8 is a perspective view, showing the rail panel stitched to the primary panel.

Next, rail panel 14 is stitched to primary panel 12, as shown in FIG. 8. In the preferred embodiment, the rail panel 14 is seam overlocked stitched to primary panel 12. The reader will appreciate that sewing is completed with tablecloth 10 inside out, such that when all steps are complete the user can invert tablecloth 10 for a sleek and snug fit around a utility table (shown in FIG. 2). Again pleat sections 26, 28, 30, 32, 34 are located on the peripheral side of rail panel 14. An optional standard hem 40, shown in FIG. 8, is lockstitched around the base of the rail panel 14.

Figure 9:
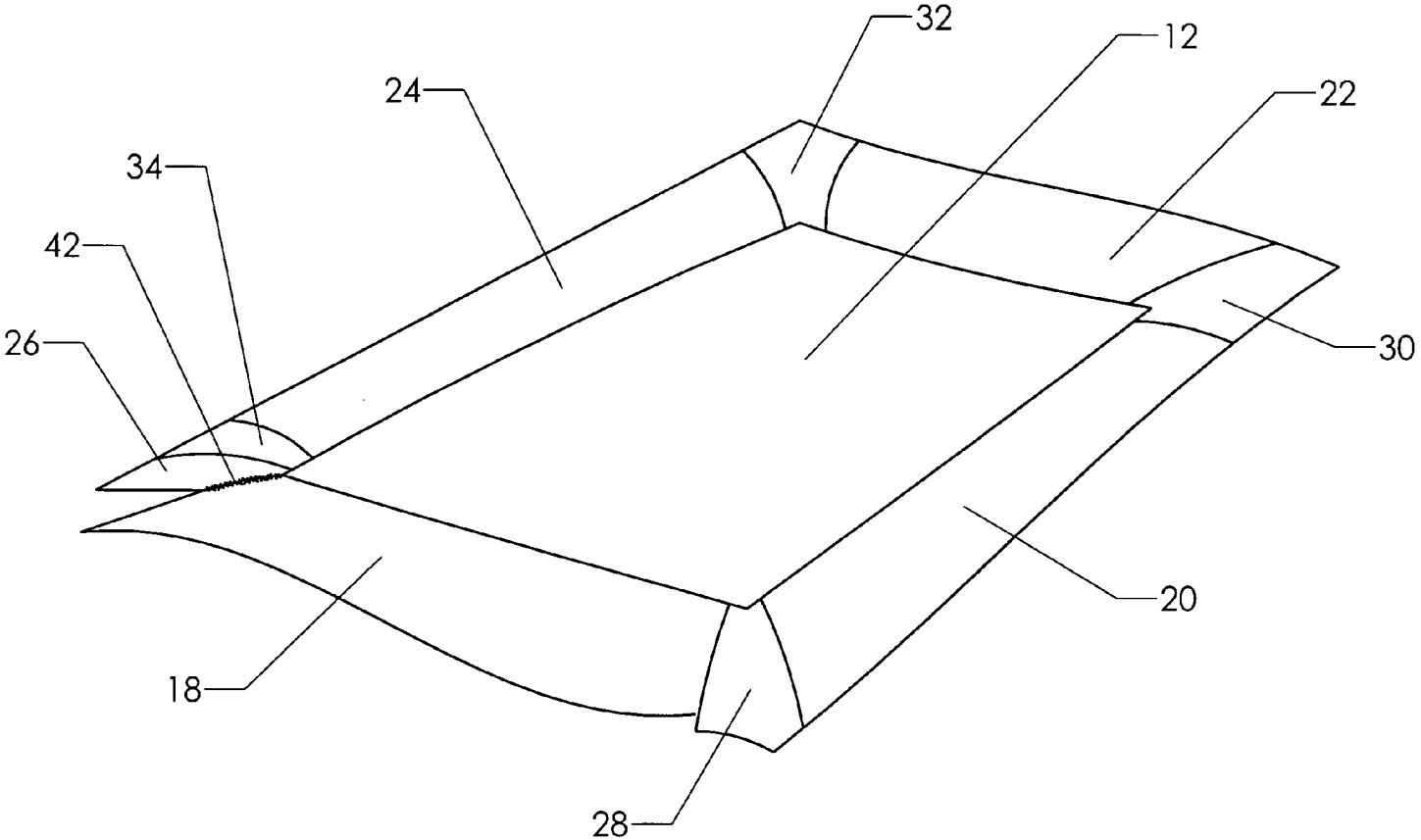
FIG. 9 is a perspective view, showing the manner in which the inner seams are stitched.

FIG. 9 illustrates the manner in which side panels (18, 20, 22, 24) are stitched to one another at inner seams 42. Inner seams 42, formed at joints of first side panel 18, and second side panel 20, second side panel 20 and third side panel 22, third side panel 22 and fourth side panel 24 and fourth side panel 24 and first side panel 18, are stitched, preferably four inches down from the top of each joint, joining together each set of panels. It is preferable that a lockstitch is used to form inner seams 42. Stitching is preferably performed by pulling back pleat to expose each joint and each respective side panel. As shown in FIG. 9, end pleat 26 is pulled back to expose fourth joint 50 which allows stitch to be made between first side panel 18 and fourth side panel 24 forming inner seam 42.

Figure 10:
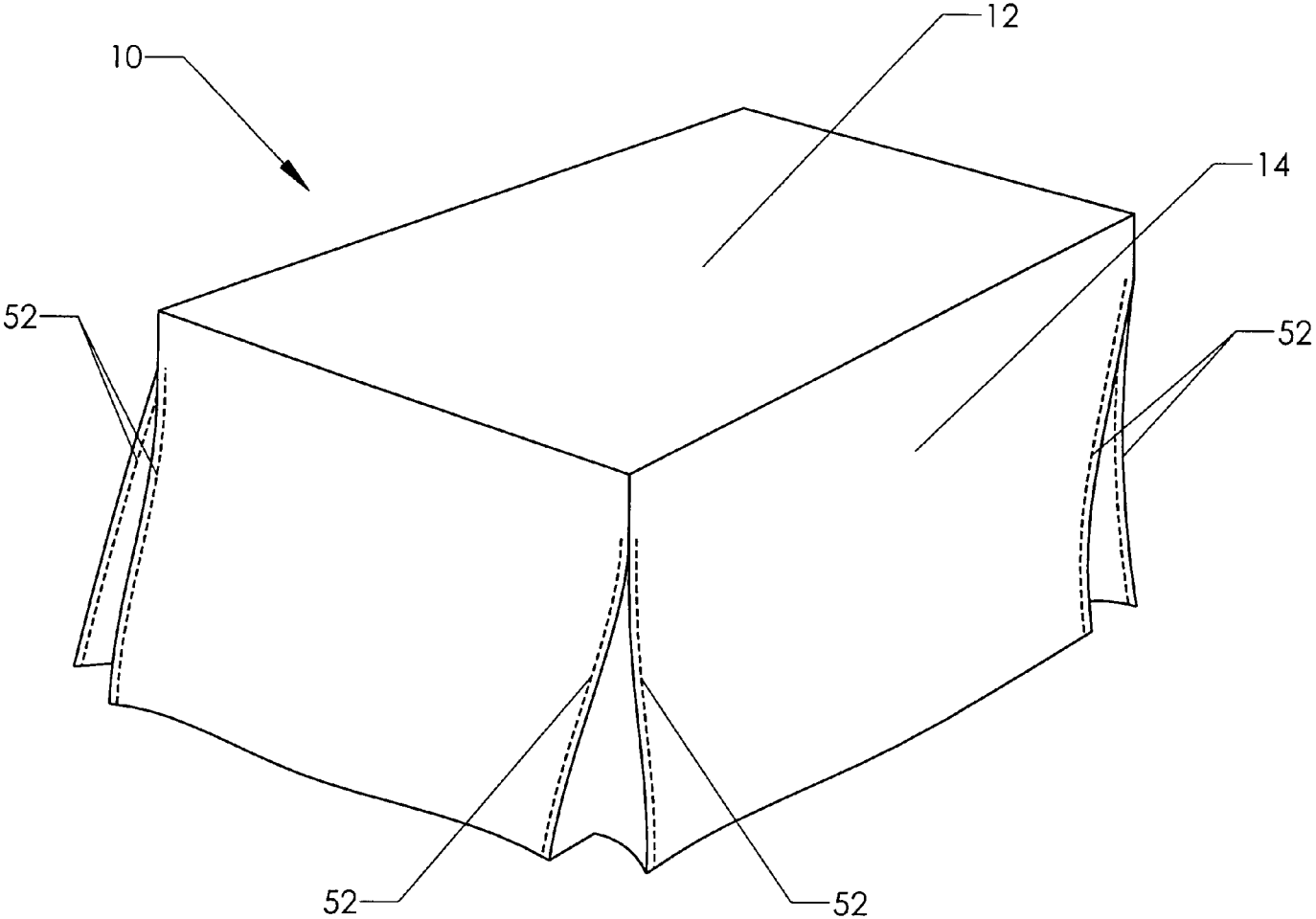
FIG. 10 is a perspective view, showing the present tablecloth with two pleat seams lockstitched per corner.
Figure 11:
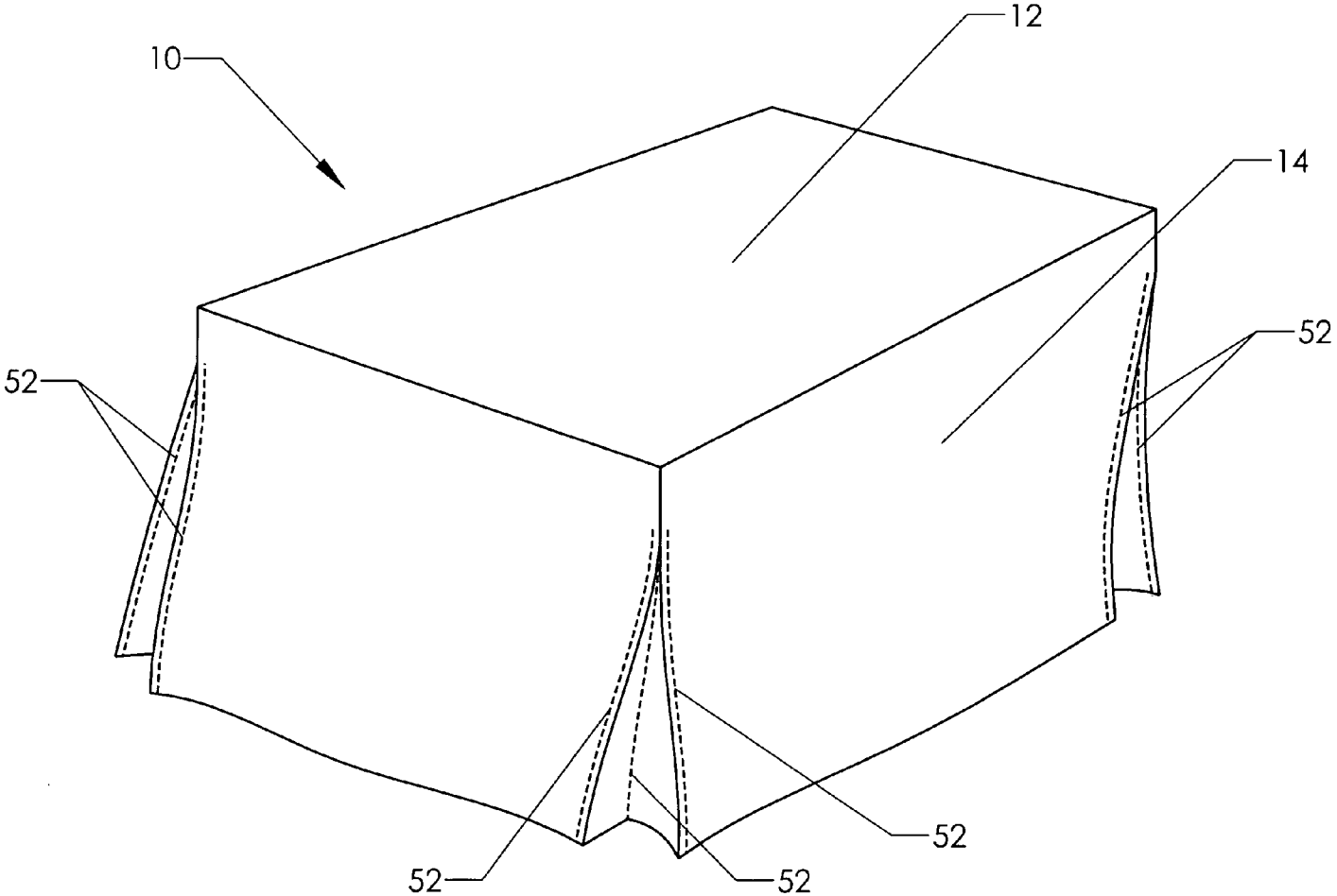
FIG. 11 is a perspective view, showing the present tablecloth with three pleat seams lockstitched per corner.

Pleat seams 52 are sewn using a lockstitch, shown in FIG. 10. Each corner will have at least two pleat seams 52; however, in the alternative, as shown in FIG. 11, three pleat seams 52 could be stitched. Pleat seams 52 better define the edges of each seam.

Although the preceding descriptions contain significant detail they should not be viewed as limiting the invention but rather as providing examples of the preferred embodiments of the invention. As an example, many different materials can be used to make the present tablecloth. Additionally, different sizes and colors of tablecloths can be made. Furthermore, inner seams can be sewn in differing lengths. Accordingly, the scope of the invention should be determined by the following claims, rather than the examples given.

Having described my invention, I claim:

1. A method of making a tablecloth, to cover a table having legs, comprising the steps of:

a. providing a primary panel having a plurality of sides;

b. providing a rail panel having a plurality of side panels and a plurality of pleats, such that said plurality of side panels are separated by said plurality of pleats;

c. folding said plurality of pleats against said plurality of side panels such that said plurality of side panels meet at a plurality of joints;

d. connecting said primary panel to said rail panel such that said plurality of side panels are connected to one another at a plurality of top joints; and e. stitching said side panels from said plurality of top joints such that a portion of the side panel meet at an inner seam.

2. A method as recited in claim 1, wherein said primary panel has four sides.

3. A method as recited in claim 1, wherein said rail panel further comprises:

a. a first end pleat;

b. a first pleat;

c. a second pleat;

d. a third pleat;

e. a second end pleat;

f. a first side panel;

g. a second side panel;

h. a third side panel; and i. a fourth side panel.

4. A method as recited in claim 3, wherein said first side panel and said second side panel form a first joint.

5. A method as recited in claim 4, wherein said second side panel and said third side panel form a second joint.

6. A method as recited in claim 5, wherein said third side panel and said fourth side panel form a third joint.

7. A method as recited in claim 6, wherein said fourth side panel and said first side panel form a fourth joint.

8. A method as recited in claim 7, further comprising sewing at least two pleat seams at each corner of said tablecloth.

9. A method as recited in claim 7, further comprising sewing at least three pleat seams at each corner of said tablecloth.

10. A method as recited in claim 7, wherein stitch in said step of stitching said side panels from said plurality of top joints to a portion of the side panel together is a lockstitch.

11. A method as recited in claim 7, wherein stitch, in said step of stitching said primary panel to said rail panel such that said plurality of side panels are connected to one another at a plurality of top joints, is an overlock stitch.

12. A method as recited in claim 1, wherein said rail panel has a base and a top and wherein said method further comprises stitching a standard hem along said base of said rail panel.

13. A method as recited in claim 12, wherein said base of said rail panel is a length that covers said legs of said table.

14. A method for making a tablecloth, to cover a rectangular table with four corners, comprising the steps of:

a. providing a primary panel having four sides;

b. providing a rail panel including:

i. a first end pleat;

ii. a first pleat;

iii. a second pleat;

iv. a third pleat;

v. a second end pleat;

vi. a first side panel;

vii. a second side panel;

viii. a third side panel; and ix. a fourth side panel;

c. folding said first pleat against said first side panel and said second side panel such that said first side panel and said second side panel meet at a first joint;

d. folding said second pleat against said second side panel and said third side panel such that said second side panel and said third side panel meet at a second joint;

e. folding said third pleat against said third side panel and said fourth side panel such that said third side panel and said fourth side panel meet at a third joint;

f. folding said first end pleat against said first side panel and said second end pleat against said fourth side panel such that said first side panel and said fourth side panel meet at a fourth joint;

g. connecting said primary panel to said rail panel;

h. stitching said first joint partially together to create an inner seam;

i. stitching said second joint partially together to create an inner seam;

j. stitching said third joint partially together to create an inner seam; and k. stitching said fourth joint partially together to create an inner seam; and l. inverting said tablecloth.

15. A method as recited in claim 14, wherein stitch in said step of stitching said side panels from said plurality of top joints to a portion of the side panel together is a lockstitch.

16. A method as recited in claim 14, wherein stitch, in said step of stitching said primary panel to said rail panel such that said plurality of side panels are connected to one another at a plurality of top joints, is an overlock stitch.

17. A method as recited in claim 14, further comprising sewing a standard hem along the base of said rail panel.

18. A method as recited in claim 14, further comprising a step of stitching a pleat seam along each pleat.

* * * * *